United States Patent [19]

Wyatt

[11] Patent Number: 4,854,388

[45] Date of Patent: Aug. 8, 1989

[54] FIRE EXTINGUISHING APPARATUS

[75] Inventor: Donald H. Wyatt, Charleston, Tenn.

[73] Assignee: American Safety Products, Cleveland, Tenn.

[21] Appl. No.: 55,171

[22] Filed: May 28, 1987

[51] Int. Cl.[4] ..... A62C 35/12

[52] U.S. Cl. ..... 169/26; 169/37; 169/38

[58] Field of Search ..... 169/26–30, 169/35, 37, 72

[56] References Cited

U.S. PATENT DOCUMENTS

| | | | |
|---|---|---|---|
| Re. 16,132 | 8/1925 | Loepsinger . | |
| 1,044,668 | 11/1912 | LaMay . | |
| 1,309,624 | 7/1919 | Hindmarsh . | |
| 1,634,976 | 7/1927 | Burke . | |
| 1,710,163 | 4/1929 | Hartney et al. . | |
| 1,887,013 | 11/1932 | Coffield . | |
| 1,909,837 | 5/1933 | Laengel . | |
| 1,939,333 | 12/1933 | Bronander . | |
| 1,966,661 | 7/1934 | Doughty | 169/26 |
| 1,988,637 | 1/1935 | Tinkham . | |
| 1,996,077 | 4/1935 | Loepsinger . | |
| 2,291,813 | 8/1942 | Knight . | |
| 2,311,845 | 2/1943 | Lindsay . | |
| 2,315,263 | 3/1943 | Lindsay . | |
| 2,464,268 | 3/1949 | Siebens . | |
| 2,469,832 | 5/1949 | Lewis . | |
| 2,484,943 | 10/1949 | Guise et al. . | |
| 2,569,975 | 10/1951 | Cone . | |
| 2,653,667 | 9/1953 | Genin et al. . | |
| 2,674,325 | 4/1954 | Siebens . | |
| 2,822,054 | 2/1958 | Howard . | |
| 3,253,657 | 5/1966 | Job . | |
| 4,121,665 | 10/1978 | Woycheese . | |
| 4,159,744 | 7/1979 | Monte et al. | 169/26 |
| 4,167,974 | 9/1979 | Job . | |
| 4,405,018 | 9/1983 | Fischer | 169/37 |
| 4,648,459 | 3/1987 | Pieczykolan | 169/38 |
| 4,739,835 | 4/1988 | Polan et al. | 169/38 |

FOREIGN PATENT DOCUMENTS

| | | |
|---|---|---|
| GB477 | of 1906 | United Kingdom . |
| 780331 | 7/1957 | United Kingdom . |

*Primary Examiner*—Sherman D. Basinger
*Assistant Examiner*—Stephen P. Avila
*Attorney, Agent, or Firm*—Baker, Mills & Glast

[57] ABSTRACT

A fire extinguishing apparatus (A) actuated either manually or automatically for dispensing a stream of pressurized fire extinguishing fluid (F) in a preferred pattern. The apparatus includes a storage tank (10) for the extinguishing medium which is operably connected with a discharge nozzle assembly (14). A conventional flexible dip tube (30) is secured within the tank in a novel manner to insure complete discharge of the tank contents which is preferably selected from various Halon agents. The discharge nozzle assembly (14) is sealed by a closure member (40) which is held in the discharge blocking position by a temperature sensitive bulb (38) and a leaf spring (36). Operation of the temperature sensitive bulb (38) enables automatic extinguisher operation which manual actuation removes the leaf spring. Either actuation releases the closure member to effect operation. The extinguishing fluid is released through slots (**34*d*) on the sides of the nozzle (34**).

14 Claims, 3 Drawing Sheets

FIRE EXTINGUISHING APPARATUS

FIELD OF THE INVENTION

This invention relates to the field of apparatus for extinguishing fires and more particularly a highly effective halon extinguishing apparatus having both automatic and manual operation modes.

BACKGROUND OF THE INVENTION

Present day fire extinguisher equipment suffers from several defects resulting in inferior performance and greater cost to the consumer.

First, present day fire extinguishers are often not designed to release the maximum amount of extinguishing fluid stored within the extinguisher. The extinguishing fluid is expelled through a rigid tube having an opening at the center of the lowest part of the extinguisher. While this configuration will release most of the extinguishing fluid when the extinguisher maintains an upright position, the bottom of the rigid tube loses contact with the extinguishing fluid when the extinguisher is rotated from an upright position. In the case of an extinguisher in a horizontal position, nearly half of the extinguishing fluid may remain within the extinguisher's container. Some extinguishers have been designed using a weight to bend the end of the tube toward the lowest point of the extinguisher regardless of orientation. Although this method increases the amount of extinguishing fluid released, it suffers from increased weight and cost of the fire extinguisher.

A second problem concerning the fire extinguisher, especially those using a Halon extinguishing compound, is improper dispersion of the extinguishing compound through the nozzle. Halon compound are neither gas nor liquid when discharged, but rather, miniature droplets surrounded by an atmosphere of gas. Previous discharge nozzles are ineffective, being designed for either gas or liquid.

A further problem associated with fire extinguishers is that they are generally not designed for both automatic (automatically releasing the extinguishing compound when a certain predetermined temperature is reached) and manual (releasing the extinguishing compound upon an action performed by the operator) operation. It is very desirable that an extinguisher can be used for both automatic and manual operation, without resulting in excessive cost to the consumer.

Therefore, a need has arisen for a fire extinguisher which is capable of releasing all of its extinguishing compound regardless of orientation, and is capable of either automatic or manual operation. Furthermore, a need has arisen for a nozzle which is effective in dispersing Halon extinguisher compounds.

SUMMARY OF THE INVENTION

The present invention relates to a new and improved fire extinguisher apparatus that is simple and inexpensive in construction, and which may be actuated either automatically or manually. The apparatus is particularly well suited for dispersing chemical fire extinguishing agents stored under pressure in a suitable container through a unique discharge nozzle assembly. A removable tank discharge head enables repeated filling, seals the container and mounts an internal flexible metal discharge conduit or dip tube to insure complete discharge of the liquid contents through the discharge nozzle assembly regardless of container orientation during use.

To insure sufficent flexibility for proper gravity positioning, the dip tube diameter to length ratio is maintained as low as possible consistent with providing an adequate liquid discharge flow rate. The helically spiraled aluminum dip tube is screwed into a mating helix in the discharge head. Such sealing and securing fit is achieved by simultaneous forcible insertion and rotational make up of the dip tube into a complementary unthreaded cylindrical recess formed in the discharge head.

The discharge nozzle assembly includes a tubular adapter, a discharge nozzle, a movable flow closure member, a temperature sensing bulb and a holding spring. The thermal responsive bulb is mounted between the spring and closure member to provide for automatic operation or actuation by releasing the closure member of a preselected temperature. The resiliently deformable leaf spring is secured within the discharge nozzle assembly and, if desired, a hand pull cable actuation means is secured to the spring. Removal of the spring also enables release of the closure member for providing manual actuation. Such manual actuation can be remotely initiated by a pull cable without a decrease in operation reliability. The discharge nozzle is slotted to enable escape of the spring, closure member and bulb fragments after actuation to avoid any restriction on extinguishing flow.

The discharge nozzle is tailored for the most efficient discharge pattern of a Halon chemical agent, such as those sold under the trademark "HALONITE". The nozzle is provided with a converging arcuate throat openings and a frontal deflector to achieve to a highly effective vapor flow pattern of miniature droplets surrounded by a flow of an inert gas vapor atmosphere.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

The preferred embodiment of the present invention is best understood by referring to FIGS. 1-4 of the drawings, like numerals being usef for like and corresponding parts of the various drawings.

Figure 1:
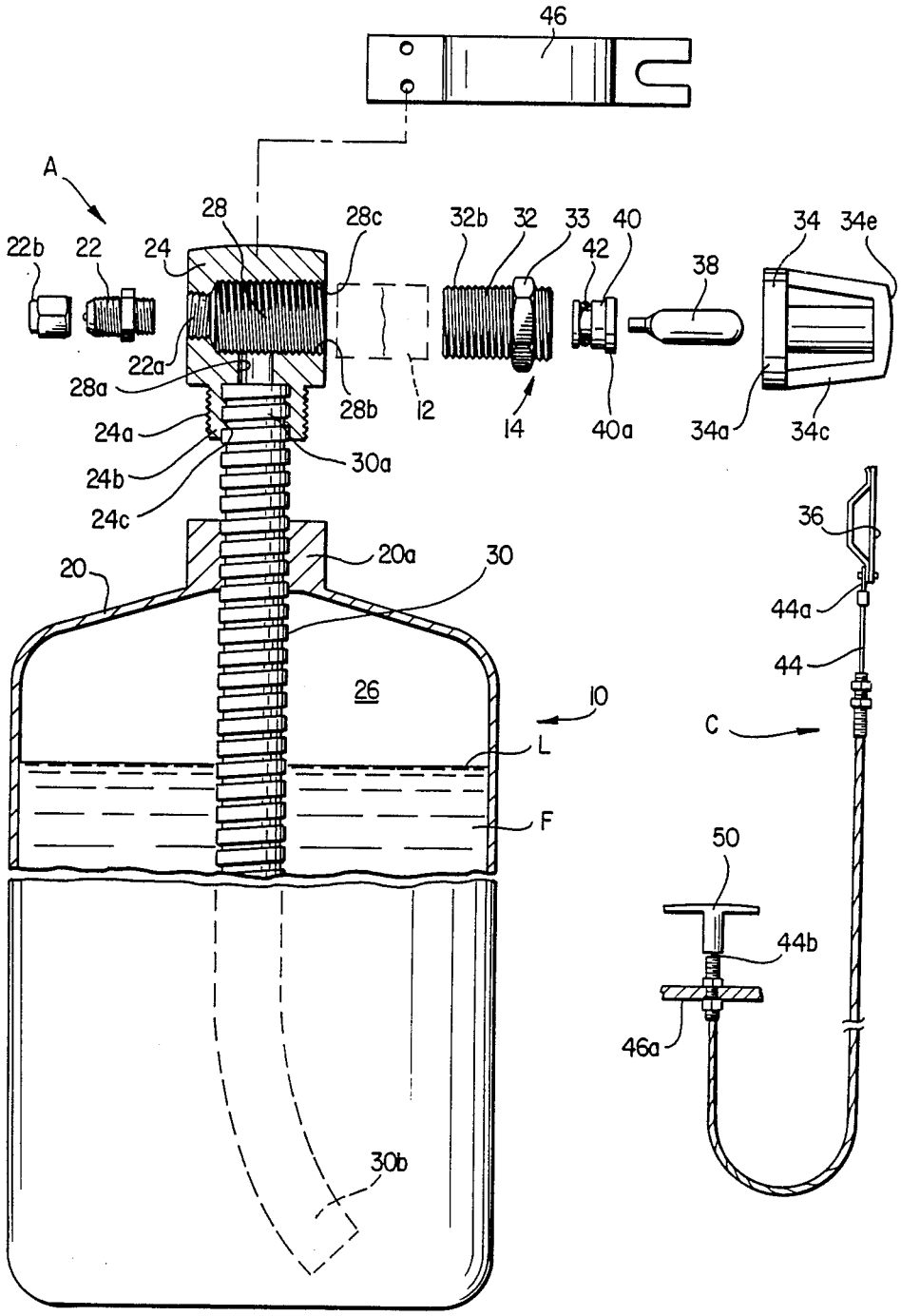
FIG. 1 is a side view, partially in section, of the fire extinguishing apparatus of the present invention.

The fire extinguishing apparatus of the present invention, generally designated A, is illustrated in FIG. 1. The apparatus A includes a fire extinguishing fluid storage container means, designated 10, which may be operably connected by a flow conduit 12 to a discharge nozzle assembly, generally designated 14. The flow conduit 12 provides a pressurized flow path from the container means 10 to the discharge nozzle assembly 14 for delivering a quantity of a fire extinguishing fluid F to extinguish the fire. The preferred fire extinguishing fluid F is stored under pressure within the container means 10 to maintain the fluid F in a compact liquid state. The apparatus A is actuated either manually or automatically to release the liquid fluid F from the discharge nozzle assembly 14 where the liquid partially converts to a vapor to extinguish the fire in the known manner.

The container means 10 includes a metal hollow pressure vessel or tank 20 having a filling valve 22 which is operably positioned in a removable discharge head 24. The tank 20 forms an enclosed chamber 26 in which the pressurized liquid fire extinguishing fluid F is stored prior to use. A preferred fire extinguishing fluid F used with the present invention is commercially sold under the registered trademark "HALONITE" or is selected from one of the other various "HALON" products that are commercially available for this purpose from a number of sources.

Stored under pressure in the enclosed chamber 26, the bulk of these chemical fluids F remain in the compact dense liquid state providing a gas-liquid interface or liquid level L. This characteristic enables the container means 10 to be small, light in weight, and thereby portable without reducing the effective capacity of the apparatus A. The metal hollow pressure vessel 20 is formed of sufficient strength to contain the pressurized fluid F in the chamber 26 in compliance with all applicable codes.

The chamber 26 can be refilled with extinguishant through filling valve 22. Filling valve 22 is seated in valve opening **22*a* in discharge head 24. End cap 22*b* covers the exposed end of filling valve 22**.

The discharge head 24 is formed with an internal flow passage 28 for enabling controlled fluid F flow from the chamber 26. The internal flow passage 28 is preferably formed by drilling intersecting inlet **28*a* and outlet 28*b* openings or holes in the discharge head 24 at right angles followed by the forming of helical threads 28*c* on the outlet 28*b*. These drilling and threading operations are relatively inexpensive and significantly reduce the cost of manufacturing the discharge head 24. The discharge head 24 is also formed with a downwardly extending sleeve projection 24*b* having an inner helix 24*c* concentrically aligned with the inlet flow passage 28*a***.

In order to provide for complete discharge of the pressurized liquid contents in the chamber 26, a flexible inlet dip tube 30 is provided. The inlet dip tube 30 has an upper end **30*a* which is forcibly secured within the inner helix 24*c* of sleeve projection 24*b* of the discharge head 24. The free open inlet end 30*b* of the dip tube 30 extends downwardly in the chamber 26 to a location adjacent the lower portion of the chamber 26** and substantially below liquid level L.

The dip tube 30 is preferably formed out of helically corrugated aluminum conduit to provide sufficient flexibility to enable continuous gravity positioning of the free inlet end **30*b*. By providing a small diameter to length ratio (tube diameter divided by tube length) of the dip tube 30 the desired gravity movement enabling flexibility is achieved without having to use a costly positioning weight on the lower end of the dip tube 30. As the pressurized fire extinguishing fluid F in the chamber 26 is maintained in the dense liquid state, the flow rate volume through the dip tube 30 is relatively low to enable the use of a slender dip tube 30. The dip tube 30 construction also prevents the pressurized gases in the upper part of the chamber 26 from escaping directly through leakage paths in the corrugated walls of the dip tube 30** caused by flexing which would render the fire extinguishing apparatus A less efficient.

The flexible aluminum conduit dip tube 30 is secured to the discharge head 24 by screwing it into the inner helix **24*c* of the sleeve projection 24*b***.

If desired, the intermediate flow conduit 12 may be eliminated and the discharge nozzle assembly 14 connected directly to the container means 10 using threads **28*c*. Alternatively, the flow conduit 12 may form a flow distribution network communicating with a plurality of discharge nozzle assemblies 14. It will also be understood that flow conduit 12 may be either rigid in construction or a flexible hose. The exact arrangement of the intermediate flow conduit 12**, if used, will be tailored to a specific preselected situation.

Figure 2:
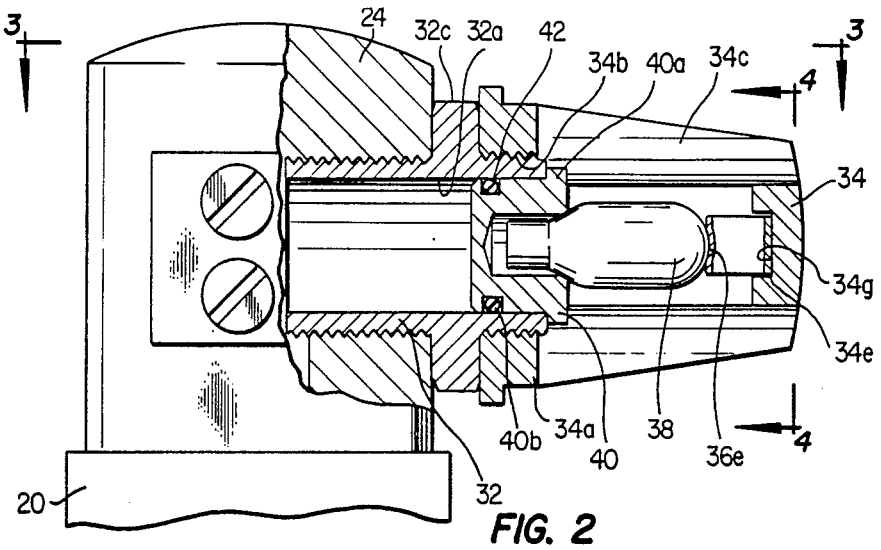
FIG. 2 is a side view, partially in section, of the discharge nozzle assembly.

As best illustrated in FIGS. 1 and 2, the discharge nozzle assembly 14 includes a tubular connecting adapter 32, a discharge nozzle 34, a biasing spring 36, a thermal bursting bulb 38 and a releasable closure member 40. The bulb 38 is of conventional temperature sensing construction for automatically rupturing or bursting at a desired temperature to release the closure member 40. The bulb 38 is positioned between the closure member 40 and spring 36 and held in that position of FIG. 2 by the resilient biasing spring 36 which helps to isolate the bulb 38 from thermal and mechanical forces for ensuring proper thermal operation of the bulb 38. Due to the automatic mode of operation provided by the bulb 38, locating the discharge nozzle assembly 14 at a location which can be protected is important. By use of conduit 12, the tank 20 need not be so located.

The tubular connecting adapter 32 is provided with an unrestricted central flow passage **32*a* that communicates with the flow passage 28 of the discharge head 24 directly or through conduit 12 for receiving the supply of fluid F. The outer surface 32*b* is provided with an external helical thread that is used to connect with either conduit 12 or threads 28*c* on the discharge head 24. An integral collar 32*c* (FIG. 2) or a conventional separate lock nut 33 (FIG. 1) may be provided for assistance and assurance in securing the adapter 32 to the discharge head 24 and discharge nozzle 34**.

The releasable closure member 40 is partially received in the flow passage **32*a* for blocking flow of the fluid F therethrough prior to actuation. The closure member 40 is provided with an outwardly extending collar 40*a* which engages the adapter 32 to limit or block further movement of the member 40 within the flow passage 32*a*. The closure member 40 also forms an annular recess 40*b* in which is securely positioned a conventional sealing o-ring 42. When inserted into the flow passage 32*a*, the o-ring 42 is resiliently deformed to block leakage of the fluid F between the closure member 40 and the adapter 32. The pressure of the stored fluid F acting on the closure member 40 is sufficient to force or move the closure member 40 from the flow passage 32*a* once it is released or no longer held in the pressure sealing position of FIG. 2**.

Figure 4:
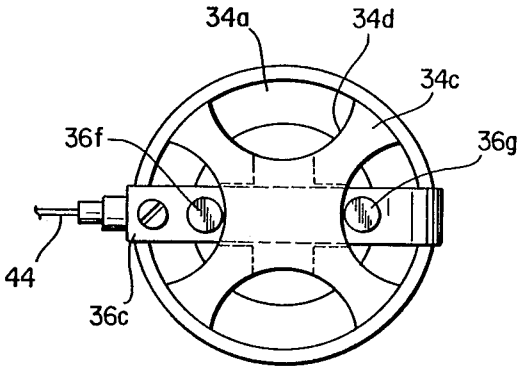
FIG. 4 is a view taken along lines 4—4 of FIG. 2.

As shown in FIGS. 2 and 4, the discharge nozzle 34 is formed with a ring-like base **34*a* having internal helical threads 34*b* for securing with the outer threads 32*b* formed on adapter 32. Protruding or extending outwardly from the base 34*a* is a plurality of circumferentially spaced support extensions or fingers 34*c* formed by cutting or machining elongated slots 34*d* therebetween. The slots 34*d* are provided and dimensioned to enable escape of the closure member 40, o-ring 42, bulb 38 fragments thereof and the spring 36 when the apparatus is actuated to enable flow and to assist in forming the discharge flow pattern from the discharge nozzle 34**.

The support fingers 34c terminate in a discharge nozzle disc 34e.

Upon discharge, the spring 36 and the bulb 38 fall out of the nozzle 34. The closure member 40 is forced to the end of the nozzle 34, where it acts as a small deflector to the Halon extinguishant.

Halon, when stored under pressure, is a liquid. As it is discharged, it turns into a gas. Thus, as it is discharged rapidly, the Halon extinguishant is a combination of small droplets of liquid surrounded by an atmosphere of gas.

Prior art Halon extingusihers have used a sprinkler type head, as is used for water-based systems. Since water remains a liquid after discharge, the splash plate of a sprinkler type head is necessary to distribute the water. However, because of the gaseous aspect of Halon, the sprinkler head is not effective in distributing Halon.

The present invention allows the Halon to escape from the slots 34d in the nozzle 34 as it is released through the adaptor 32. The discharge nozzle disc 34e and closure member 40 act as deflectors to force the Halon outward, resulting in a wide distribution of Halon for more effective coverage.

Figure 3:
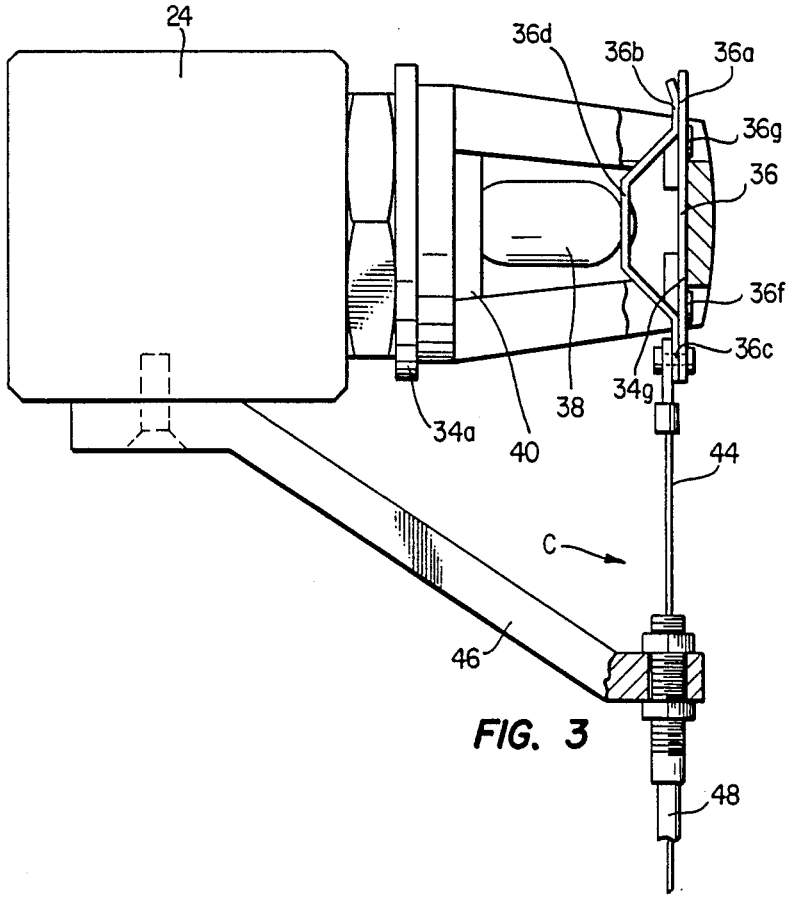
FIG. 3 is a view taken along line 3—3 of FIG. 2.

The biasing leaf spring means 36 is formed of a support base 36a and a cantilevered resilient leaf 36b which are secured or fixed together at one end 36c (FIG. 3). The other end of the resilient leaf 36b engages the base 36a but is freely movable thereon to provide the desired flex. The central portion 36d of the leaf 36b is spaced from the base 36a and is indented on recess at disc portion 36e to maintain engagement with the bulb 36. The discharge nozzle disc 34e is provided with an internal support surfaces flats 34g for receiving and holding the support base 36a. The support base 36a is preferably formed with a pair of keeper projections or lugs 36f and 36g (FIG. 3) that engage both sides of the disc portion 36e of the discharge nozzle 34 when the spring is operably positioned on the flat 34g to prevent inadvertent sliding release of the biasing spring 36 from vibration or the like.

As long as the discharge nozzle assembly 14 is in the ready condition of FIG. 2, discharge flow is blocked by the closure member 40 and the fluid F contained in the chamber 26 maintained under pressure. Bursting of the bulb 38 in response to a sensed temperature will enable movement of the closure member 40 from the adapter 32 to automatically enable actuation of the apparatus A. Manual actuation is achieved in a similar manner, but by slideably removing the spring 36 with a side pull. The flex of the leaf 36b enables projection 36g to move across the support flat 34g in response to a firm pull. Preferably, the spring 36 is removed using a pull cable means arrangement.

The manual pull cable means C is partially illustrated in FIG. 3 where the attachment of one end of the movable pull cable 44 to the spring 36 is shown. The exact manner of attachment to the spring 36 is not critical as long as the spring 36 is removed from the discharge nozzle 34 to release the bulb 38 and closure member 40 to enable flow in the manner described. The other or handle release actuating end of the pull cable 44 is placed at any desired safe location for actuating the apparatus A. As illustrated in FIG. 3, an attachment strap 46 may be secured to the discharge head 24 if desired to support the manual operating pull cable 44 adjacent the tank 20.

As illustrated in FIG. 1, the pull cable mechanism C for remotely manually activating the apparatus is illustrated. A preferable form of the invention includes a stationary protective cable jacket 48 (FIG. 3) in which is positioned the movable operating cable 44. One end 44a of the operating cable is attached to the leaf spring 36 while the other or handle operating end 44b is secured to an actuating pull handle 50. Manual pull manipulation of the handle 50 will extract the spring 36 from the discharge nozzle 34 to actuate extinguishing flow. The handle 50 may be located either at the tank 10 using attachment strap 46 or remotely from any desired or convenient suitable location 46a for securing the cable jacket 48.

The foregoing disclosure and description of the invention are illustrative and explanatory thereof, and various changes in the size, shape and materials, as well as in the details of the illustrated construction, may be made without departing from the spirit or scope of the invention.

What is claimed is:

1. A fire extinguishing apparatus, including:

a container forming an interior chamber for storing a fire extinguishing fluid under pressure and having an opening for providing communication with said chamber;

a discharge head securable in said opening and having means for sealing said discharge head with said container to enable pressurization of said chamber, said discharge head having a flow opening formed therethrough for enabling communication of said chamber through said discharge head, said flow opening having an inlet opening communicating with said interior chamber and an outlet opening disposed externally of said container;

a discharge nozzle assembly operably communicating with said outlet opening of said discharge head for forming a desired discharge flow stream of a predetermined pattern of the pressurized fluid from said chamber for extinguishing a fire;

said discharge nozzle having a plurality of arms for forming openings therebetween to provide a desired discharge pattern of a discharge stream of gas having entrained droplets; and a deflector comprising a closure member operable to seal said outlet opening in a closed position, and operable to deflect said gas and droplets toward said openings in an open position.

2. The apparatus as set forth in claim 1 wherein said arms connect to an end portion.

3. The apparatus as set forth in claim 1, including:

a single length of a flexible dip tube disposed in said internal chamber having an inlet end and an outlet end;

said outlet end of said dip tube having means for securing to said discharge head with said outlet end in sealed flow communication with said inlet opening of said discharge head;

said inlet end of said dip tube disposed in said internal chamber for enabling unrestricted entry into said inlet end; and said dip tube having a length to diameter ratio to provide sufficient flexibility to enable the weight of the metallic dip tube to gravity position the inlet end adjacent the lowest part of said chamber.

4. The apparatus as set forth in claim 3, wherein:

said dip tube is formed by sealed helical spirals of aluminum; and said discharge head having a recess adjacent said inlet opening for forcibly receiving a portion of the sealed helical spirals for sealably securing said outlet end of said dip tube with said discharge head.

5. The apparatus as set forth in claim 3, wherein:

said dip tube is formed by sealed helical spirals of aluminum; and said discharge head having a cylindrical recess adjacent said inlet opening for deforming a portion of the dip tube inserted therein to receive and seal said dip tube with said discharge head.

6. The apparatus as set forth in claim 1, including:

a flexible dip tube having a helical outer portion disposed in said internal chamber having an inlet end and an outlet end;

said discharge head having a helical inner portion adjacent said inlet opening; and said dip tube sealingly securable in said helical inner portion by insertion while rotating.

7. The apparatus as set forth in claim 1, wherein said discharge nozzle further includes:

an adapter for receiving a supply of fire extinguishing fluid, said adapter forming an internal flow passage in flow communications with the supply of fire extinguishing fluid from said discharge head;

a discharge nozzle securable with said adapter and having a central opening communicating with said flow passage for discharging the fire extinguishing fluid in an effective application pattern to extinguish a fire;

said closure member positioned in the flow passage of said flow adapter adjacent said discharge nozzle to block flow of fire extinguishing fluid through said flow passage, said closure member engaging said adapter in said closed position to block movement through said flow passage toward said discharge head;

a temperature sensing bulb engaging said closure member to maintain said closure member in sealing engagement with said adapter; and a spring member mounted with said discharge nozzle and engaging said bulb for resiliently holding said bulb and maintaining said closure member in said closed position engaging said adapter.

8. The apparatus as set forth in claim 7, wherein:

said closure member forms an annular recess adjacent said adapter; and an o-ring disposed in said annular recess for deformably sealing between said closure member and said adapter to prevent leakage of fluid therebetween.

9. A discharge nozzle assembly for use in a fire extinguishing apparatus including:

a tubular adapter for receiving a supply of fire extinguishing fluid, said adapter forming an internal flow passage in flow communication with the supply of fire extinguishing fluid;

a discharge nozzle securable with said adapter and communicating with said flow passage for discharging the fire extinguishing fluid in an effective application pattern to extinguish a fire;

a closure member positioned in said flow passage of said flow adapter to block flow of a fire extinguishing fluid through said flow passage, said closure member engaging said adapter to block further movement through said flow passage away from said central opening and operable to deflect said fluid in said effective application pattern when in a flow allowing position;

a sensed temperature burstable bulb engaging said closure member to maintain said closure member in flow blocking engagement with said adapter; and a spring mounted with said discharge nozzle and engaging said bulb for resiliently holding said bulb and said closure member in the flow blocking position.

10. The assembly as set forth in claim 9, wherein:

said closure member forms an annular recess adjacent said adapter; and an o-ring disposed in said annular recess for deformably sealing between said closure member and said adapter to prevent leakage of fluid therebetween.

11. The assembly as set forth in claim 9, wherein:

said spring having a base and a resilient leaf, said base having a plurality of retainers for co-acting with said slots on said discharge nozzle to prevent inadvertent release of said spring from mounting with said discharge nozzle.

12. the assembly as set forth in claim 9, wherein:

said bulb is constructed to burst at a prearranged temperature to release said closure member from sealing engagement with said adapter into said flow allowing position to enable automatic extinguishing flow from the discharge nozzle.

13. The assembly as set forth in claim 9, including:

a manual pull cable having one end connected to said spring to displace said spring when said pull cable is operated to release said closure member from said adapter to manually enable extinguishing flow.

14. The assembly as set forth in claim 13, wherein:

said pull cable having a handle end located remotely from said discharge nozzle for actuating discharge flow.

* * * * *